US011154103B2

(12) United States Patent
Sposito et al.

(10) Patent No.: US 11,154,103 B2
(45) Date of Patent: Oct. 26, 2021

(54) ADJUSTABLE CONTOUR WAIST SYSTEM

(71) Applicant: Stone Glacier, Inc., Bozeman, MT (US)

(72) Inventors: Jeffrey R. Sposito, Bozeman, MT (US); Kurt Racicot, Bozeman, MT (US)

( * ) Notice: Subject to any disclaimer, the term of this patent is extended or adjusted under 35 U.S.C. 154(b) by 243 days.

(21) Appl. No.: 16/683,343

(22) Filed: Nov. 14, 2019

(65) Prior Publication Data

US 2020/0178627 A1 Jun. 11, 2020

Related U.S. Application Data

(60) Provisional application No. 62/777,116, filed on Dec. 8, 2018.

(51) Int. Cl.
*A41D 20/00* (2006.01)
*A41D 1/06* (2006.01)

(52) U.S. Cl.
CPC ..... *A41D 20/00* (2013.01); *A41D 1/065* (2013.01); *A41D 2300/32* (2013.01)

(58) Field of Classification Search
CPC ..... A41D 1/065; A41D 2300/32; A41D 2300/322; A41D 2400/44; A41F 9/00; A41F 9/02; A41F 9/025
See application file for complete search history.

(56) References Cited

U.S. PATENT DOCUMENTS 1,123,160 A * 12/1914 Allum ..... A41F 9/00 2/236
4,803,740 A 2/1989 Dawson
5,163,184 A 11/1992 Reardon
D423,762 S * 5/2000 Dale ..... A41D 1/084 D2/828
6,434,754 B2 8/2002 Kato
7,950,070 B2 5/2011 Beven
8,713,715 B1 * 5/2014 Lewis ..... A41D 1/065 2/227
D751,274 S 3/2016 Moore
2004/0133960 A1 * 7/2004 Rausch ..... A41D 13/02 2/69
2005/0102729 A1 * 5/2005 Snedeker ..... A41D 27/24 2/96
2009/0007314 A1 1/2009 Beven
2010/0071111 A1 * 3/2010 Riondato ..... A41D 1/084 2/79
2013/0031698 A1 * 2/2013 Valles ..... A41D 1/08 2/221
2014/0338101 A1 11/2014 Moore
2020/0178627 A1 * 6/2020 Sposito ..... A41F 9/00

* cited by examiner

*Primary Examiner* — Sally Haden
(74) *Attorney, Agent, or Firm* — Antoinette M. Tease

(57) ABSTRACT

An adjustable contour waist system in which a garment has a waistband and a fly area, first and second belt loops, and a piece of webbing that passes through the second belt loop. The fly area has a zipper that is made up of two parts, and the second part of the zipper is only attached to the garment at a joinder seam. This same joinder seam joins the overlying and underlying fabrics of the fly area. A strip of hook fastener material is sewn to the second part of the zipper and also joined to the garment at the joinder seam. The joinder seam is the only place at which the second part of the zipper and the strip of hook fastener material are attached to the garment. The fly area also has a section of loop fastener material on the underside of the overlying fabric.

7 Claims, 10 Drawing Sheets

ADJUSTABLE CONTOUR WAIST SYSTEM

CROSS-REFERENCE TO RELATED APPLICATION

This application claims the benefit of U.S. Patent Application No. 62/777,116 filed on Dec. 8, 2018, the contents of which are incorporated herein by reference.

BACKGROUND OF THE INVENTION

1. Field of the Invention

The present invention relates generally to the field of apparel, and more particularly, to an adjustable contour waist system that enables the waist size to be increased or decreased to fit the wearer.

2. Description of the Related Art

The following patent filings are directed toward solving the problem of adjusting the width of a closure mechanism of a garment. Because of structural differences between these inventions and the present invention, none of these inventions solves the problem of avoiding the bunching of fabric on the waistband of a pant.

U.S. Pat. No. 4,803,740 (Dawson, 1989) discloses a method of adapting a lower body garment for use during early term pregnancy. The method includes the steps of co-linearly securing strips of a hook-and-loop fastener fabric to each side of the vertical zipper area, providing an adapter means in the form of an inverted triangle made of a flexible fabric with strips of hook-and-loop fastener along both diagonal sides of the adapter, and then securing the adapter means to both sides of the zipper area with buttons. This invention requires a separate piece to be attached to an existing garment; it is not an adjustable waist system that is integral to the garment itself.

U.S. Pat. No. 5,163,184 (Reardon, 1992) provides an expanded waistband structure for garments. This invention is similar to that disclosed in the '740 patent in that it constitutes a separate piece of fabric that is inserted into the fly area. In one embodiment, the material flap is attached to both sides of the existing fly area with hook-and-loop fastener. Because the hook-and-loop fastener strips are not movable (they are sewn to the existing fly area and material flap), there is limited ability to adjust the waistband as compared to the present invention.

U.S. Pat. No. 6,434,754 (Kato, 2002) discloses a closure system for a pair of pants that utilizes a hook assembly made of metal or synthetic resin. The hook assembly includes two hooks that allow the waist size to be adjusted to one of two positions. A piece of adjusting cloth is stitched to the inside of one part of the existing zipper to provide coverage when the waist size is adjusted to the larger position.

U.S. Pat. No. 7,950,070 (Beven, 2011) describes a pair of short with a waistband that has a self-gripping strip. A first pair of strips of hook-and-loop material is secured to the vertical parts of the fly to provide for fly closure. A second pair of strips of hook-and-loop material is situated horizontally along the waistband and configured to permit the waistband to be adjusted. As with the invention covered by the '184 patent, the hook-and-loop fasteners are stitched to the garment itself and are not movable. This means that when the waistband is adjusted, the material will bunch. The present invention solves the problem of bunching by allowing the hook-and-loop material to be moved relative to the garment itself.

U.S. Patent Application Pub. No. 20140338101 (Moore) describes an adjustable waistband in which a slit is cut in the rear center of the waistband, and an underlying segment is stitched onto one side of the slit underneath an overlying segment that is part of the garment as it existed before the slit was cut. Hook-and-loop fastener material is affixed to the inside of the overlying segment and the outside of the underlying segment to allow the waistband to be adjusted. As with other inventions discussed above, the hook-and-loop fastener does not move relative to the garment itself but is fixedly attached to the garment. U.S. Pat. No. D751274 (Moore, 2016) illustrates the same design covered by the utility patent. This design would cause the fabric to bunch when the waistband is adjusted.

U.S. Pat. No. D423762 (Dale, 2000) shows a jacket extending panel with parallel and complimentary zipper parts on either side of what is presumably a panel of flexible fabric.

BRIEF SUMMARY OF THE INVENTION

The present invention is an adjustable contour waist system comprising: a garment having a waistband and a fly area; a first belt loop situated on the waistband on a first side of the fly area; a second belt loop situated on the waistband on a second side of the fly area; and a piece of webbing that is sewn to the waistband and configured to pass through the second belt loop; wherein the fly area comprises an overlying piece of fabric and an underlying piece of fabric; wherein the fly area further comprises a hook-and-loop fastener consisting of a strip of hook fastener material and a section of loop fastener material; wherein the waistband comprises a first end that is sewn to the overlying piece of fabric and a second end that is sewn to the underlying piece of fabric so that the first end and the second end overlap one another; wherein the first end of the waistband comprises a first end, and a first buckle part extends laterally from the first edge of the first end; wherein the webbing comprises a second buckle part that is configured to form a clasp together with the first buckle part; wherein the second buckle part is configured to slide on the webbing to tighten or loosen the waistband; wherein the fly area comprises a zipper that is sewn onto the underlying fabric and is parallel to an inside edge of the underlying fabric; wherein the zipper comprises a first part and a second part; wherein the strip of hook fastener material is sewn onto the second part of the zipper so that the strip of hook fastener material is parallel to the zipper; wherein the zipper has a length, the strip of hook fastener material has a length, and the length of the zipper and the length of the strip of hook fastener material are the same; wherein the section of loop fastener material is sewn to an underside of the overlying fabric; wherein the section of loop fastener material comprises an inner edge and an outer edge; wherein the section of loop fastener material has a bottom edge and a top edge that are parallel to one another; wherein the section of loop fastener material has a width, and the width of the section of loop fastener material increases from bottom to top; wherein the strip of hook fastener material has a constant width; wherein the inner edge of the strip of hook fastener material is sewn to the second part of the zipper; wherein the strip of hook fastener material comprises a bottom edge, and the only part of the strip of hook fastener material that is attached to the underlying fabric is the bottom edge of the strip of hook fastener material; wherein the bottom edge of the strip of hook fastener material is attached to the underlying fabric by a joinder seam; wherein the joinder seam joins the underlying fabric to the overlying fabric; wherein the strip of hook fastener material is not affixed to the underlying fabric at any point that does not also connect the hook fastener strip to the overlying fabric; wherein the bottom edge of the loop fastener section is situated above the joinder seam; wherein the first part of the zipper and the second part of the zipper are secured to the overlying fabric and the underlying fabric at the joinder seam; and wherein the second part of the zipper is attached to the garment only at the joinder seam.

In a preferred embodiment, the width of the section of loop fastener material at the top edge of the section of loop fastener material is twice the width of the section of loop fastener material at the bottom edge of the section of loop fastener material. Preferably, the width of the section of loop fastener material at the top edge of the section of loop fastener material is three times the width of the strip of hook fastener material. The top edge of the section of loop fastener material is preferably sewn into a bottom edge of the waistband.

In a preferred embodiment, the inner edge of the section of loop fastener material is parallel to an inner edge of the overlying fabric. Preferably, the strip of hook fastener material has a length, the section of loop fastener material has a length, and the length of the hook fastener material is greater than the length of the section of loop fastener material. The inner edge of the section of loop fastener material is preferably configured so that when the fly area is closed in a first position, the inner edge of the section of loop fastener material lies directly on top of an inner edge of the strip of hook fastener material.

REFERENCE NUMBERS

1 Waistband
1*a* Bottom edge (of waistband)
2 Fly area
3 Overlying piece of fabric
3*a* Inner edge (of overlying fabric)
3*b* Top edge (of overlying fabric)
4 Underlying piece of fabric
4*a* Top edge (of underlying fabric)
5 Hook fastener strip
5*a* Inner edge (of hook fastener strip)
5*b* Bottom edge (of hook fastener strip)
6 Loop fastener section
6*a* Inner edge (of loop fastener section)
6*b* Outer edge (of loop fastener section)
6*c* Bottom edge (of loop fastener section)
6*d* Top edge (of loop fastener section)
7 First end (of waistband)
7*a* First edge (of first end)
8 Second end (of waistband)
9 First buckle part
9*a* Second buckle part
10 First belt loop
11 Second belt loop
12 Webbing
13 Zipper
13*a* First part (of zipper)
13*b* Second part (of zipper)
13*c* Bottom edge (of zipper)
14 Inside edge (of underlying fabric)
15 Joinder seam

DETAILED DESCRIPTION OF INVENTION

A. Overview

The present invention solves the problem of improper pant waist fit by providing a pant waist system that can be adjusted by the user for an exact fit and/or to accommodate other layers of clothing underneath the pant waist. Experiencing a waist size that is too small or too large is a common problem for individuals who fall between sizes of fixed waist size pants. The present invention allows the waist size to be adjusted without bunching of pant fabric along the waistline when adjusted to a smaller waist size. In other adjustable waist pants, the bunching of fabric around the waist causes discomfort underneath the hip belt of a backpack when an individual is packing heavy loads while hiking.

In backpacking situations, individuals will layer clothing to prepare for adverse weather conditions. A typical layering system may include up to four different layers of pants worn in various combinations at any given time. For this reason, individuals will typically purchase an outer layer pant that is larger in size to provide ample room for layering underneath during colder conditions. When the pants are worn without multiple layers underneath, the waist is too large, and the wearer must rely on a belt or other pant cinching system in order for the pants to fit properly. These kinds of waist adjustment mechanisms result in excessive pant material bunching underneath the backpack hip belt, which causes irritation and discomfort. The present invention solves this problem by providing an adjustable waist system that can be adjusted to an exact fit (with or without underlying layers) and does not cause fabric to bunch around the waist of the user.

B. Detailed Description of the Figures

Figure 1:
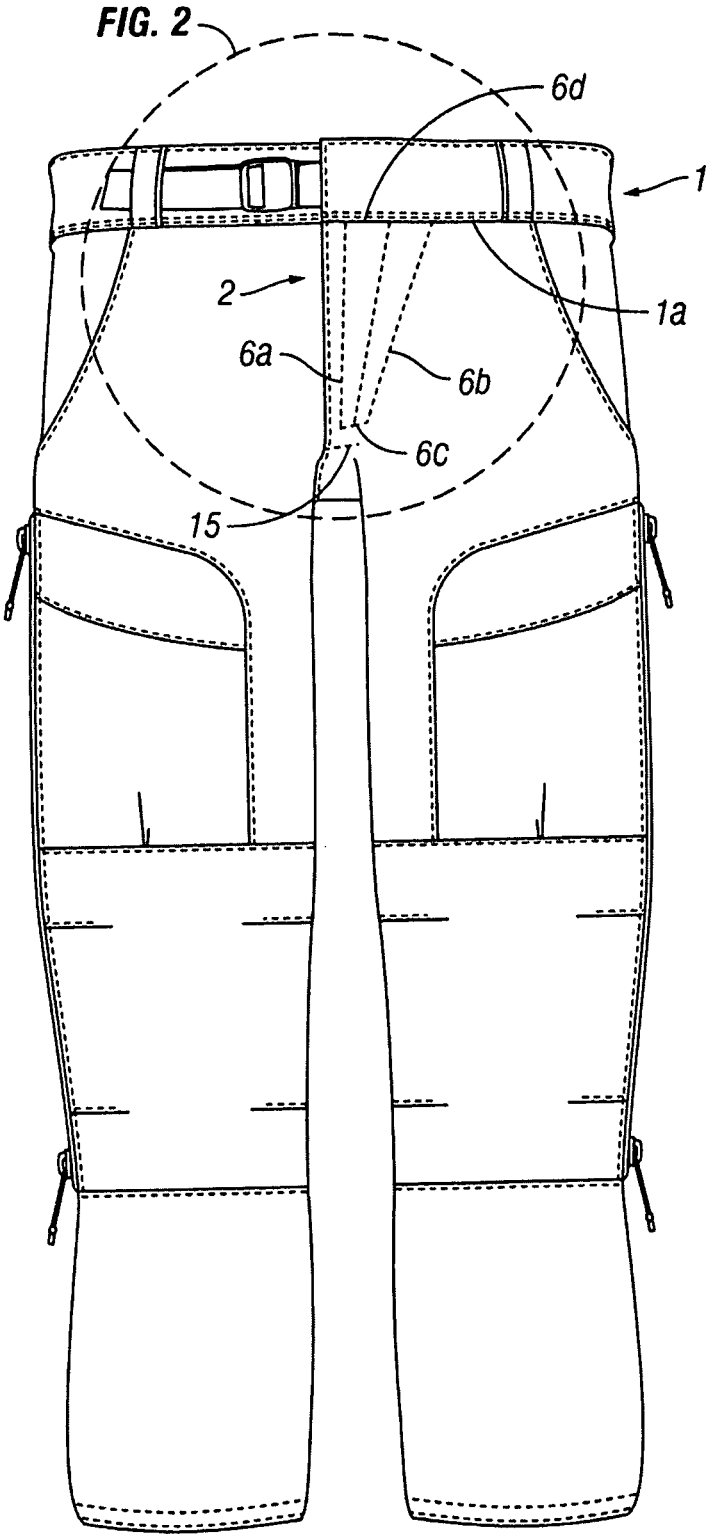
FIG. 1 is a perspective view of a garment with the adjustable contour waist system of the present invention.

FIG. 1 is a perspective view of a garment with the adjustable contour waist system of the present invention. In this figure, the present invention is incorporated into a pair of pants, but the invention may be used with any garment that has a waistband.

The invention comprises a waistband 1 and a fly area 2. The fly area 2 comprises an overlying piece of fabric 3 and an underlying piece of fabric 4 (see FIG. 7). It also comprises a hook-and-loop fastener consisting of a hook fastener strip 5 and a loop fastener section 6 (see FIG. 3).

Figure 2:
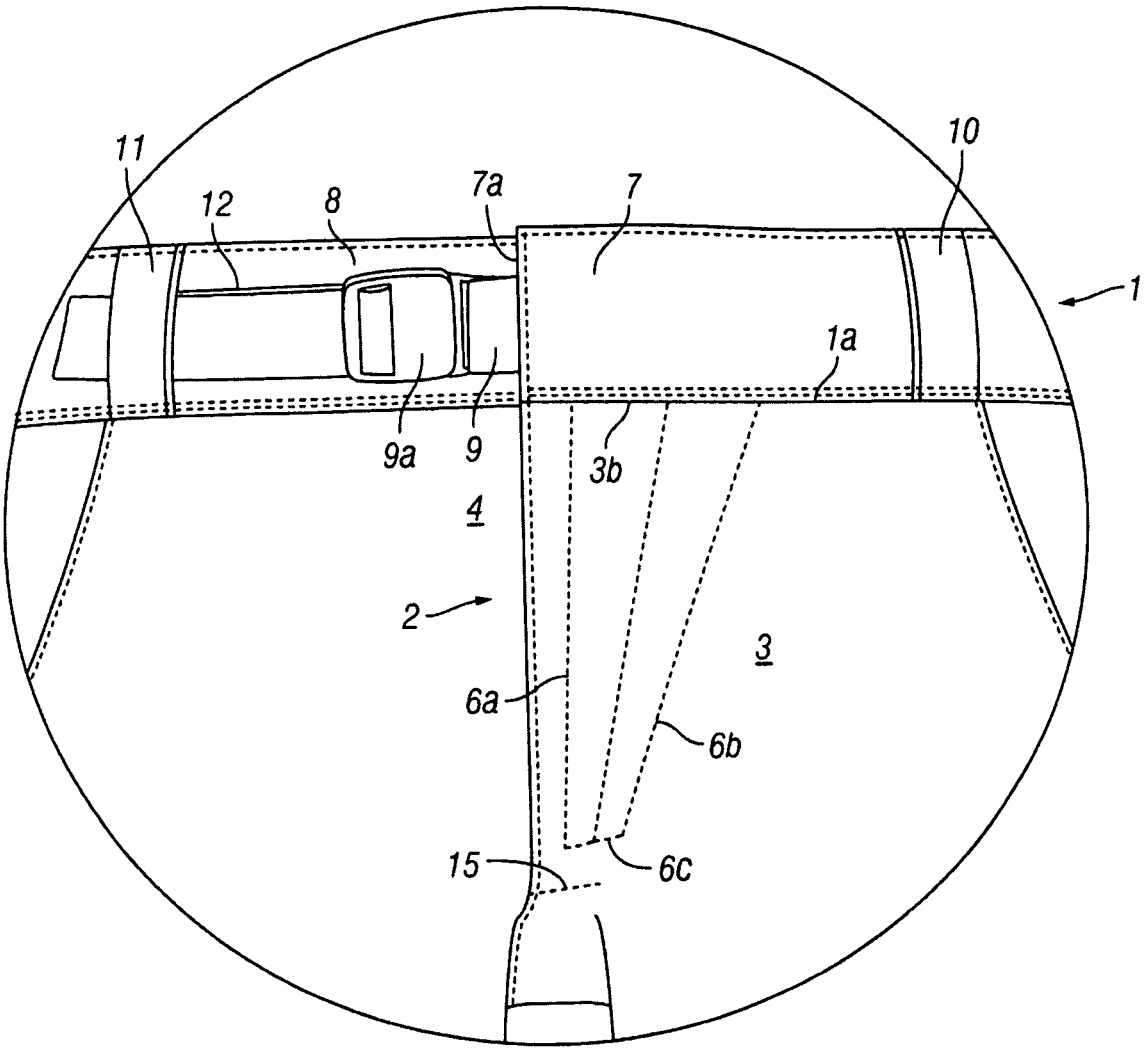
FIG. 2 is a detail view of the front part of the garment shown with the waistband in a first position.

FIG. 2 is a detail view of the front part of the garment shown with the waistband in a first position. As shown in this figure, the waistband 1 comprises a first end 7 that is sewn to the overlying piece of fabric 3 and a second end 8 that is sewn to the underlying piece of fabric 4 so that the first and second ends 7, 8 overlap one another. Extending laterally from the first edge 7*a* of the first end 7 is a first buckle part 9. First and second belt loops 10, 11 are preferably situated on the waistband on either side of the fly area 2. A piece of webbing 12 is preferably sewn to the waistband directly underneath the second belt loop 11. The webbing 12 comprises a second buckle part 9*a* that is configured to form a clasp together with the first buckle part 9. The second buckle part 9*a* slides on the webbing 12 to tighten or loosen the waistband 1.

Figure 3:
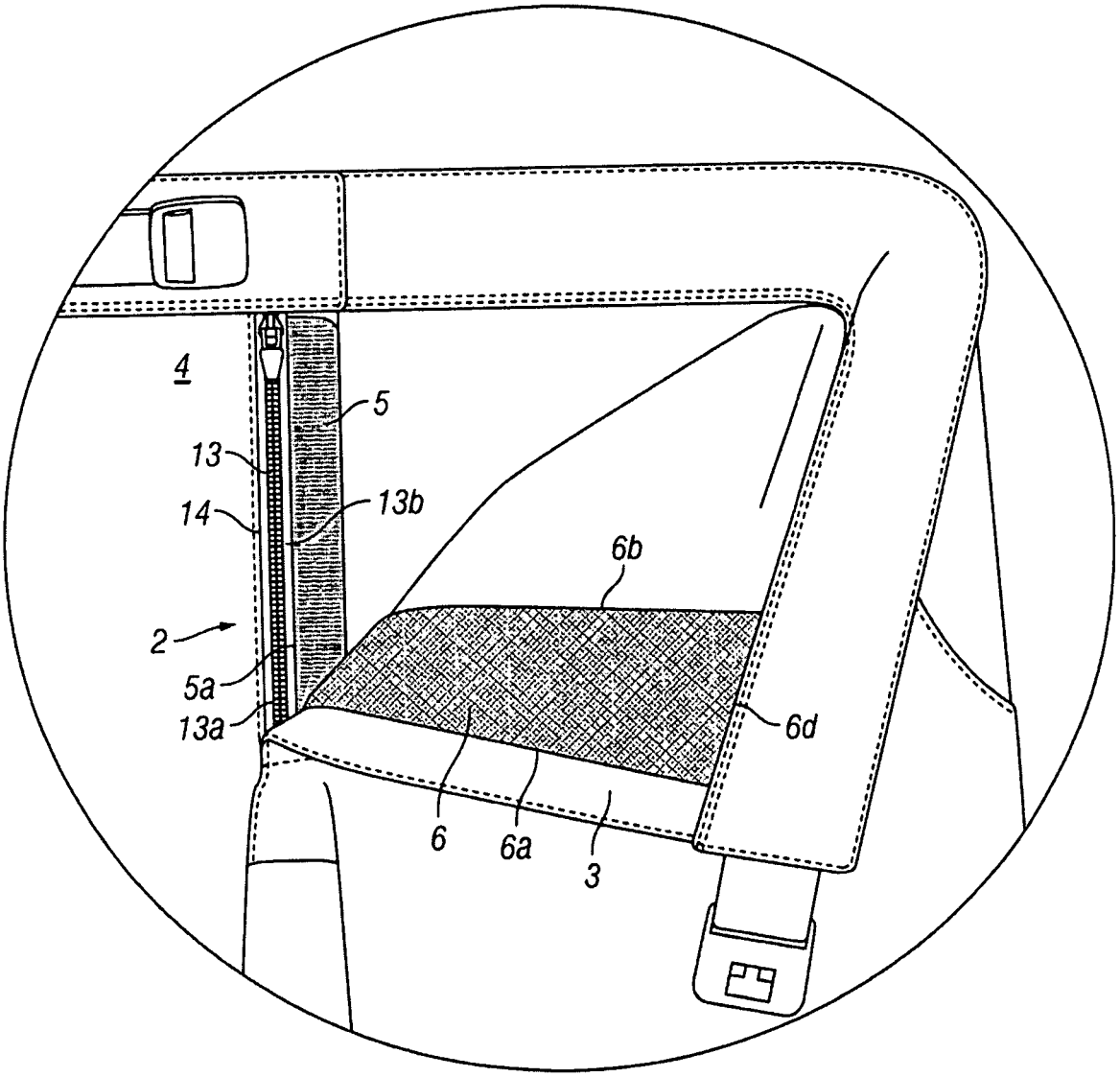
FIG. 3 is a detail view of the front part of the garment shown with the fly open and the zipper fully closed.

FIG. 3 is a detail view of the front part of the garment shown with the fly open and the zipper fully closed. As shown in this figure, the fly area 2 comprises a zipper 13 that is sewn onto the underlying fabric 4 and is parallel to an inside edge 14 of the underlying fabric. The zipper 13 comprises a first part 13*a* and a second part 13*b*. A strip of hook fastener material 5 (also referred to herein as the "hook fastener strip") is sewn onto the second part 13*b* of the zipper so that the hook fastener strip 5 is parallel to the zipper 13. The hook fastener strip 5 runs along the entire length of the zipper 13, from top to bottom.

A loop fastener section 6 is sewn to the underside of the overlying fabric 3. The loop fastener section 6 comprises an inner edge 6*a* and an outer edge 6*b*. The inner edge 6*a* of the loop fastener section 6 is configured so that when the fly area 2 is closed in a first position, the inner edge 6*a* of the loop fastener section 6 lines up with (lies directly on top of) the inner edge 5*a* of the hook fastener strip 5. The loop fastener section 6 has a bottom edge 6*c* (see FIG. 4) and a top edge 6*d*. The bottom edge 6*c* and top edge 6*d* are preferably parallel to one another, but the inner edge 6*a* and outer edge 6*b* are not (see also FIG. 5). The width of the loop fastener section 6 increases from bottom to top so that the width of the top edge 6*d* of the loop fastener section 6 is approximately twice the width of the bottom edge 6*c*. The hook fastener strip 5 has a constant width, and the width of the top edge 6*d* of the loop fastener section 6 is preferably approximately three times the width of the hook fastener strip 5. The width of the bottom edge 6*c* of the loop fastener section 6 is preferably 1.5 times the width of the hook fastener strip 5.

Figure 4:
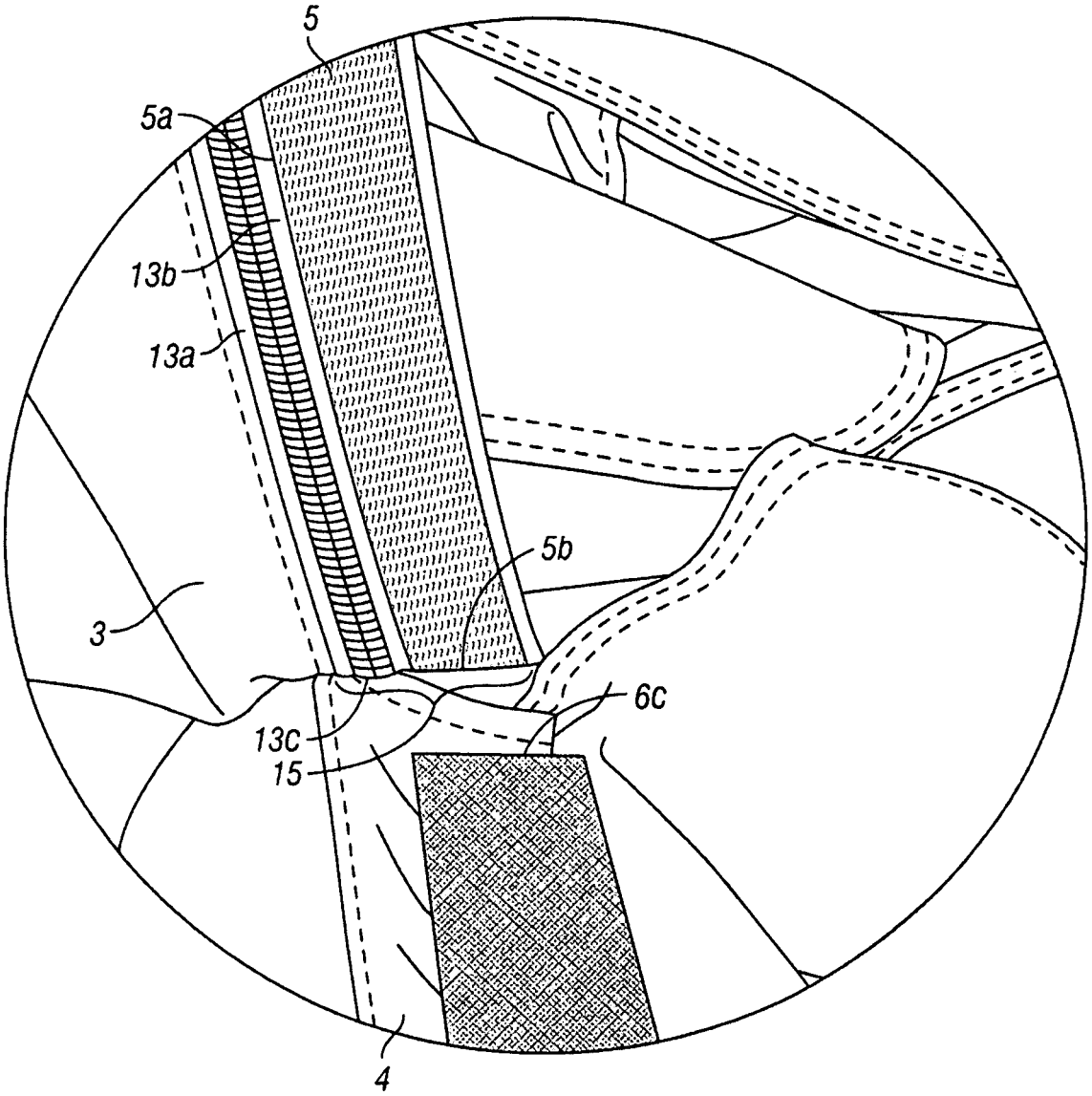
FIG. 4 is a detail view of the bottom of the fly area as shown in FIG. 3.

FIG. 4 is a detail view of the bottom of the fly area as shown in FIG. 3. As shown in this figure, the inner edge 5*a* of the hook fastener strip 5 is sewn to the second part 13*b* of the zipper 13, but only the bottom edge 5*b* of the hook fastener strip 5 is sewn to the underlying fabric 3. It is important to note that the hook fastener strip 5 is not affixed to the underlying fabric 3 at any point other than the bottom edge 5*b* of the hook fastener strip 5. The joinder seam 15 is the seam at which the bottom edge 5*b* of the hook fastener strip 5 is sewn to the underlying fabric 3. It is also the same seam that joins the underlying fabric 3 to the overlying fabric 4; therefore, the hook fastener strip 5 is not affixed to the underlying fabric at any point that does not also connect the hook fastener strip 5 to the overlying fabric 3. The joinder seam 15 and inner edge 6*a*, outer edge 6*b*, bottom edge 6*c* and top edge 6*d* of the loop fastener section 6 are also visible from the front of the garment (see FIG. 1). The top edge 6*d* of the loop fastener section 6 is sewn into the bottom edge 1*a* of the waistband. The bottom edge 6*c* of the loop fastener section 6 is situated above the joinder seam 15 (see also FIG. 1); therefore, the strip of hook fastener material is slightly longer than the section of loop fastener material. Both parts of the zipper 13*a*, 13*b* are also secured to the overlying fabric 3 and the underlying fabric 4 at the joinder seam 15. As with the hook fastener strip 5, the second part 13*b* of the zipper is attached to the garment only at the joinder seam and nowhere else. This is an important distinction as compared to the prior art.

Figure 5:
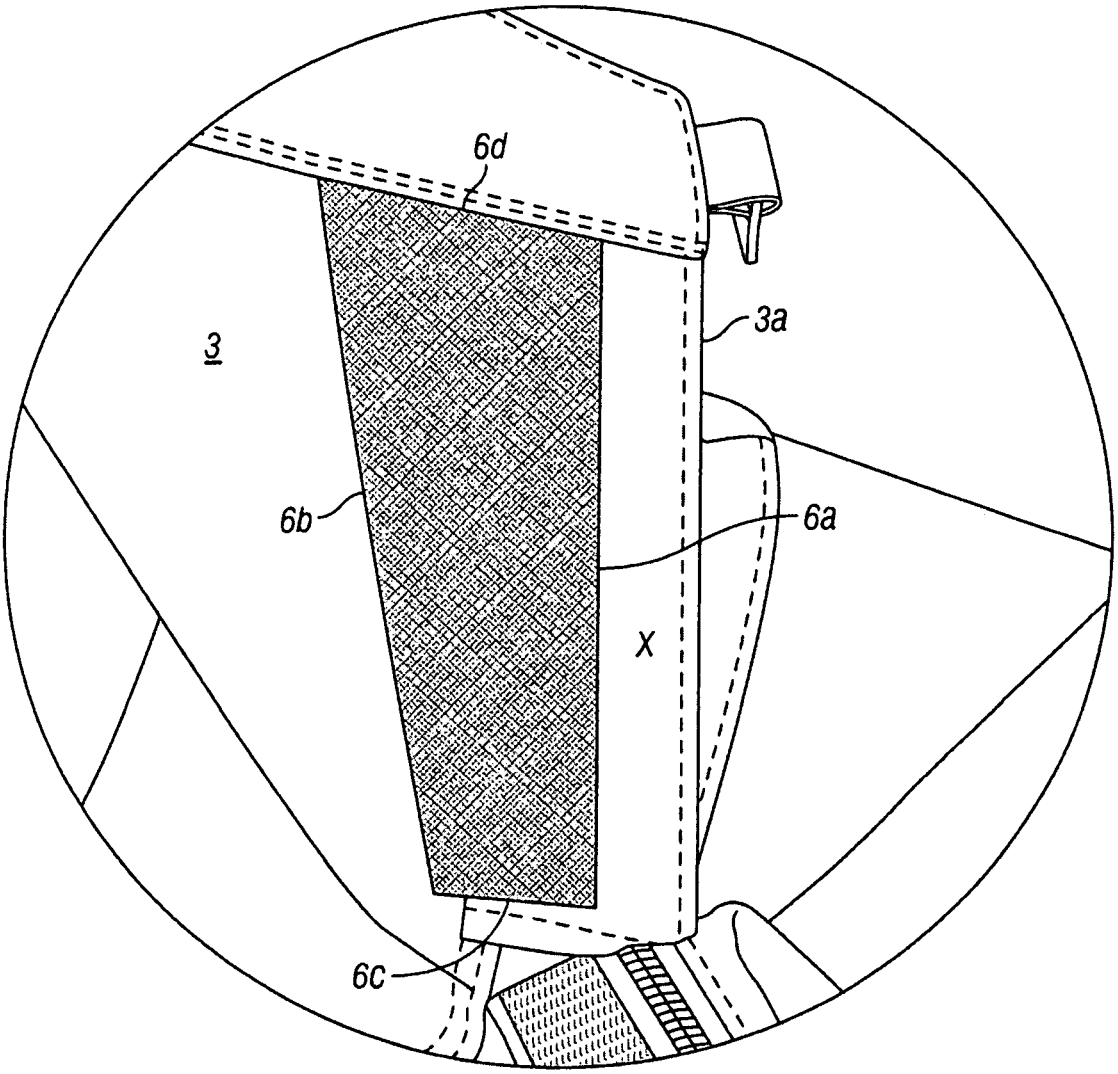
FIG. 5 is a detail view of the loop fastener section shown from the inside of the garment.

FIG. 5 is a detail view of the loop fastener section shown from the inside of the garment. As shown in this figure, the inner edge 6*a* of the loop fastener section 6 is parallel to the inner edge 3*a* of the overlying fabric 3. When the fly area 2 is closed and in a first position, the zipper 13 is covered by that portion of the overlying fabric 3 that lies between the inner edge 6*a* of the loop fastener section 6 and the inner edge 3*a* of the overlying fabric 3 (see "X" on FIG. 5). When the fly area 2 is closed and in a second position, the zipper is covered by the loop fastener section 6.

Figure 6:
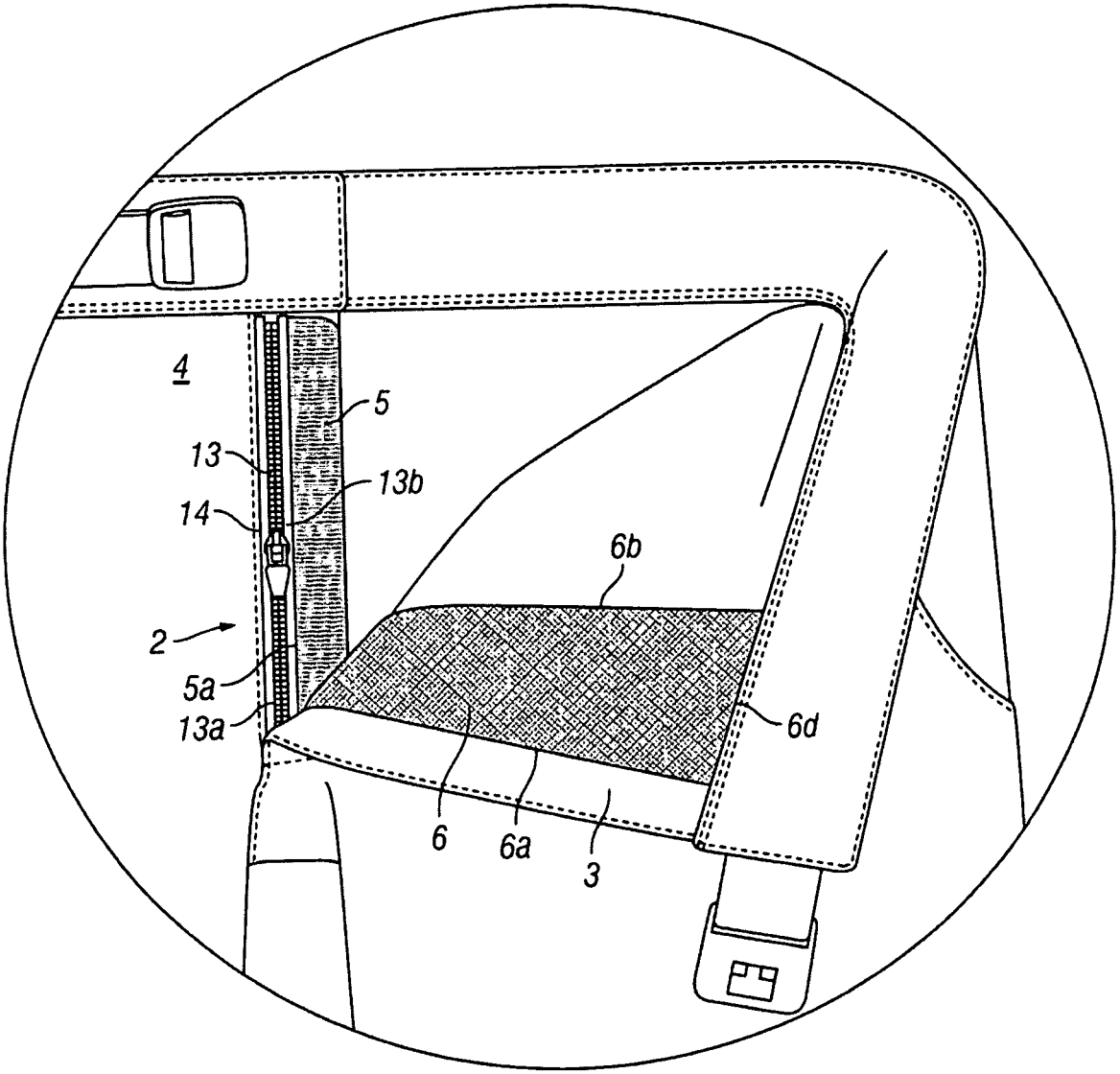
FIG. 6 is a detail view of the front part of the garment shown with the fly open and the zipper partially unzipped.

FIG. 6 is a detail view of the front part of the garment shown with the fly open and the zipper partially unzipped. Note that the fly area 2 may be opened either by unzipping the zipper 13 or by disengaging the hook fastener strip 5 from the loop fastener section 6. In this figure, the hook fastener strip 5 has been disengaged from the loop fastener section 6. The wearer would open the fly in this manner if he desired to adjust the size of the waistband.

Figure 7:
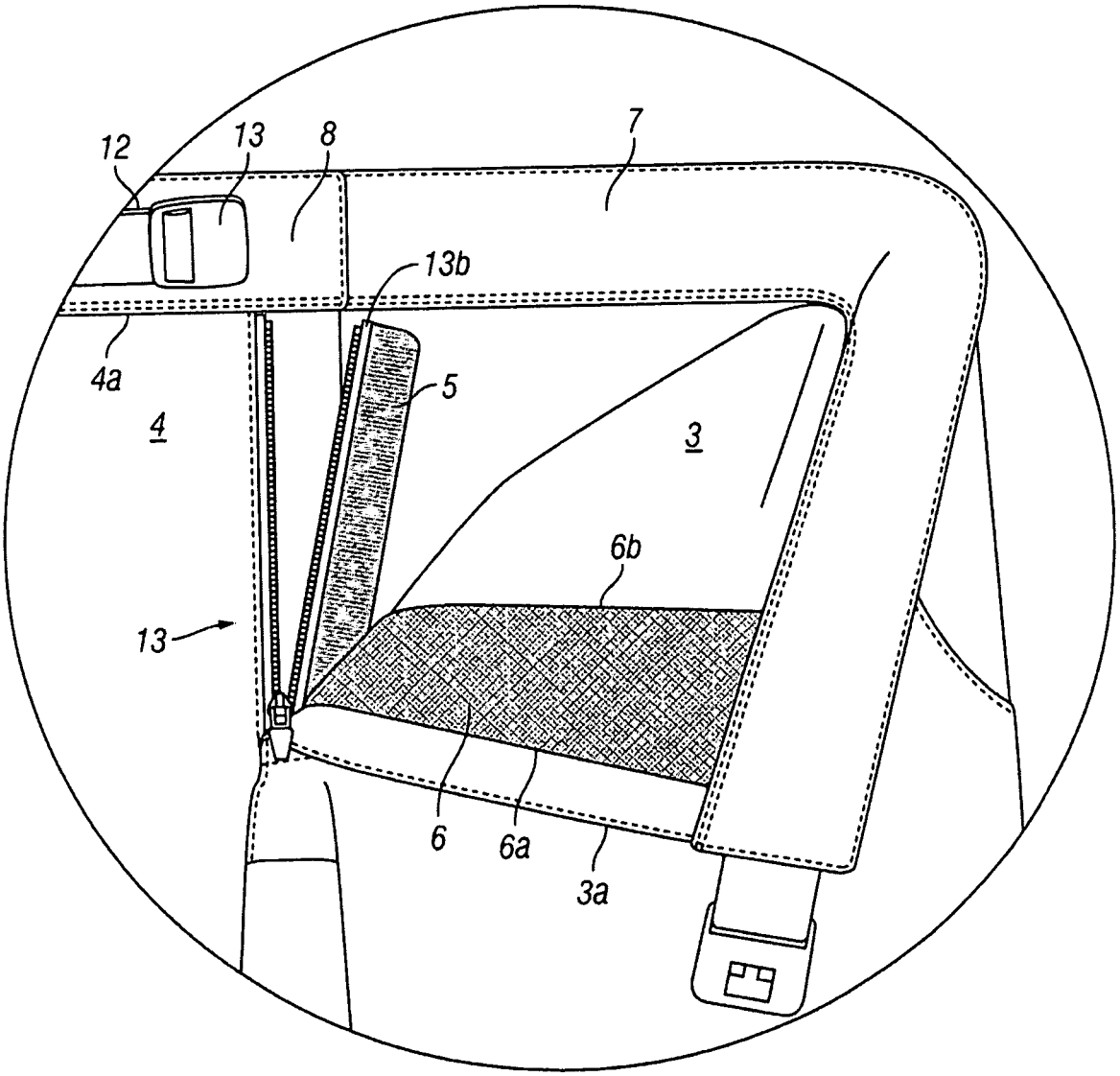
FIG. 7 is a detail view of the front part of the garment shown with the fly open and the zipper fully unzipped.
Figure 10:
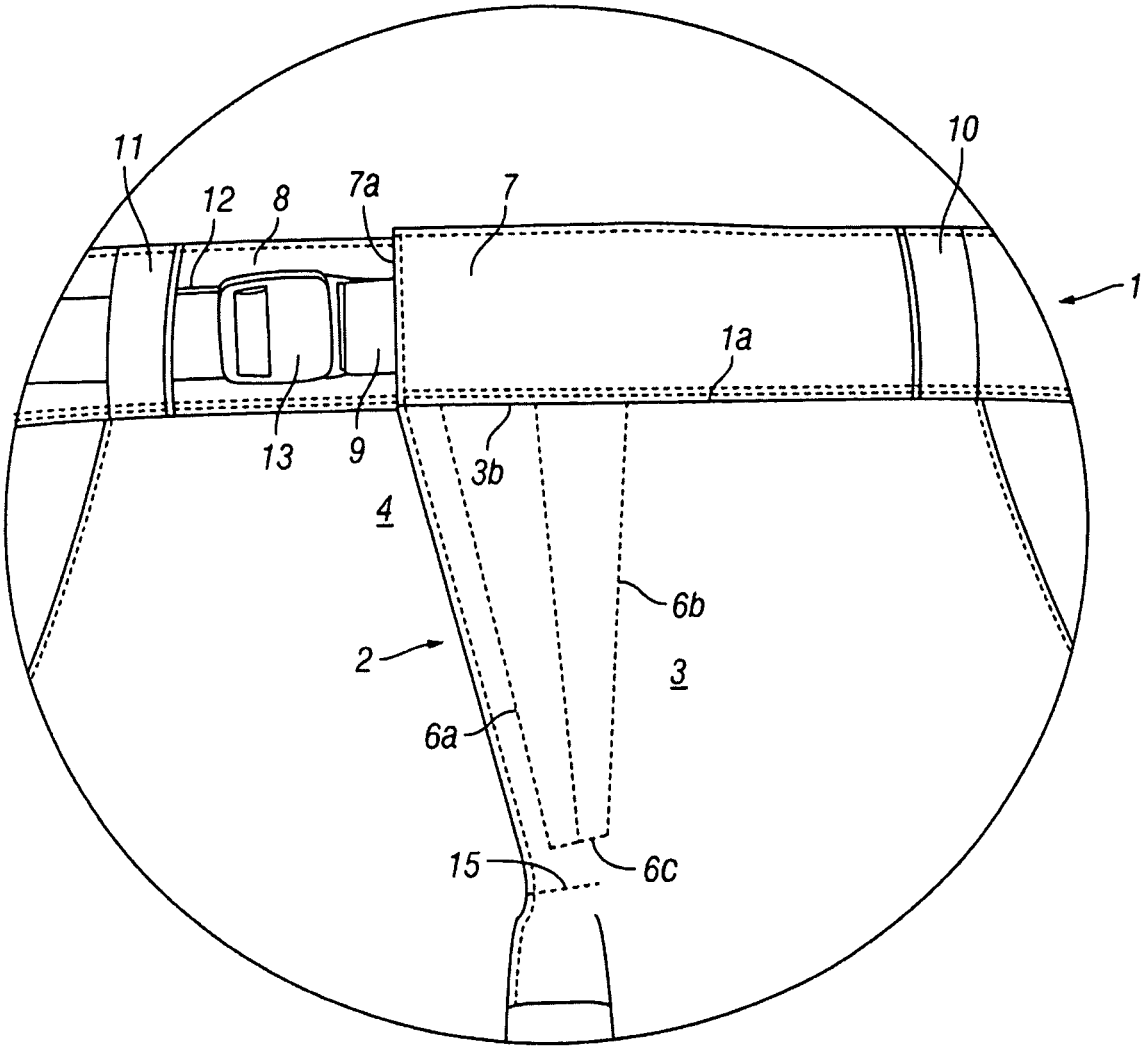
FIG. 10 is a detail view of the front part of the garment shown with the waistband in a second position.

FIG. 7 is a detail view of the front part of the garment shown with the fly open and the zipper fully unzipped. The hook fastener strip 5 may now be repositioned relative to the loop fastener section 6 (from a first position to a second position). Because the hook fastener strip 5 is attached (sewn) to the second part 13*b* of the zipper 13, when the hook fastener strip 5 is repositioned on the loop fastener section 6 to a second position, the second part 13*b* of the zipper 13 is moved further outward (that is, closer diagonally to the outer edge 6*b* of the loop fastener section 6 than the inner edge 6*a* and further away diagonally from the inner edge 3*a* of the overlying fabric). When the zipper is zipped back up, because the first part 13*a* of the zipper 13 is attached (sewn) to the underlying fabric 4 and the hook fastener strip 5 is secured to the loop fastener section 6, the overlying fabric 3 is pulled inward. Because the top edge 3*b* of the overlying fabric 3 is attached (sewn) to the bottom edge 1*a* of the first end 7 of the waistband 1, as the overlying fabric 3 is pulled inward, the first end 7 of the waistband 1 is pulled further over the second end 8, thereby decreasing the overall width of the waistband 1. The webbing 12 is tightened on the second buckle part 9*a*, and there is no buckling of fabric (see FIG. 10).

Figure 8:
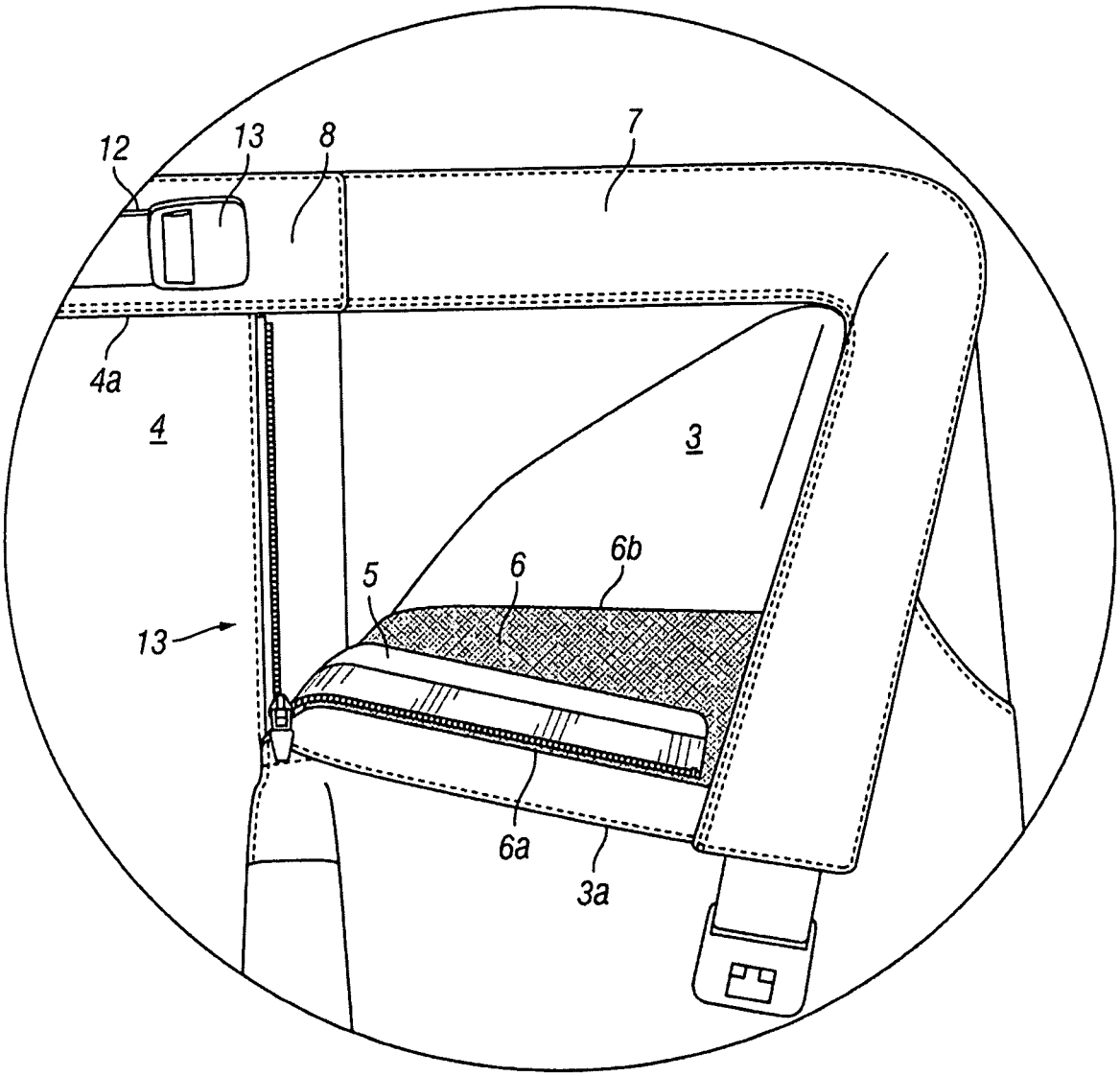
FIG. 8 is a detail view of the front part of the garment shown with the fly open and the zipper placed onto the loop fastener section in a first position.
Figure 9:
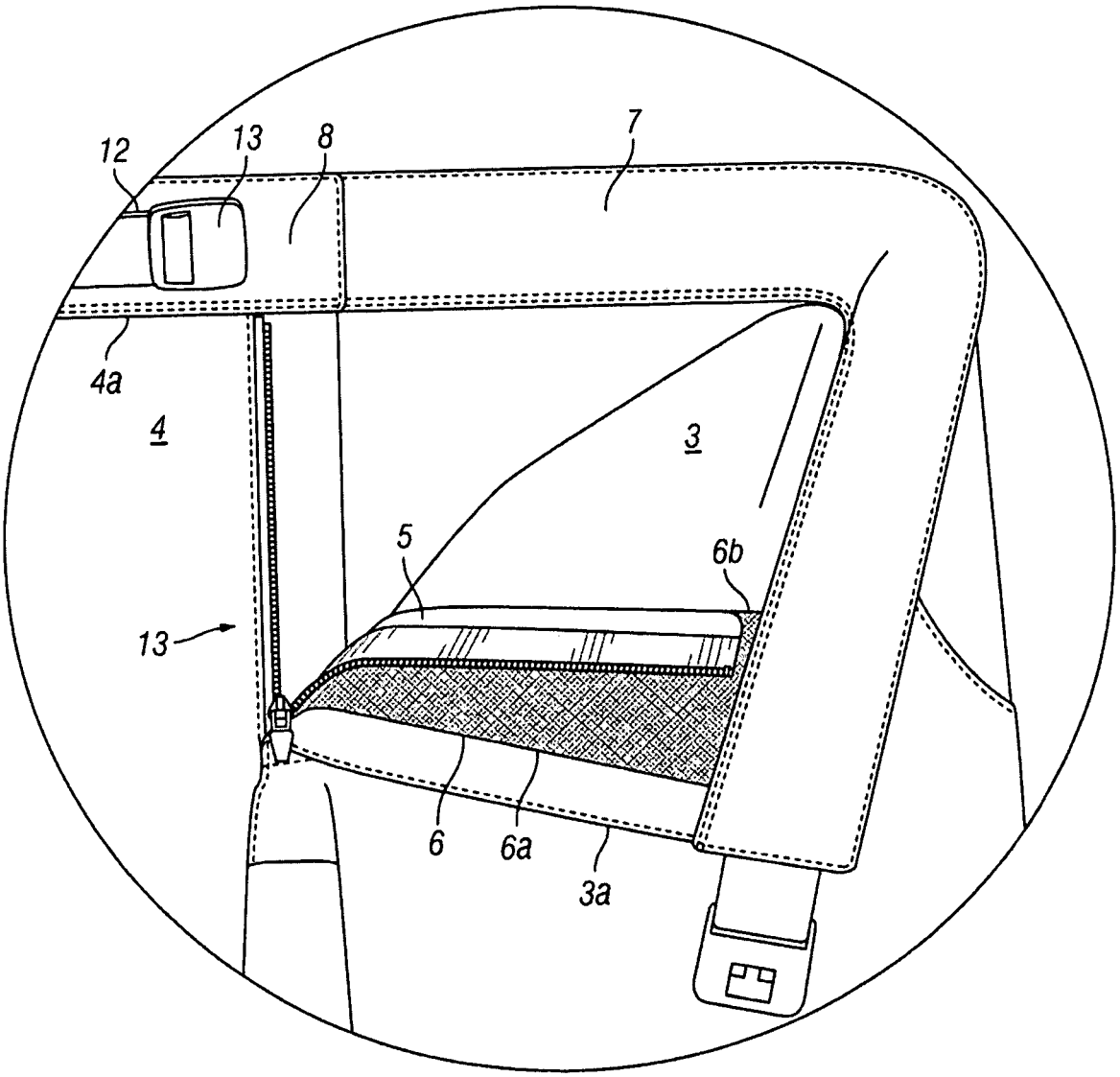
FIG. 9 is a detail view of the front part of the garment shown with the fly open and the zipper placed onto the loop fastener section in a second position.

FIG. 8 is a detail view of the front part of the garment shown with the fly open and the zipper placed onto the loop fastener section in a first position. The position shown in this figure is the position that affords the greatest waistband width. FIG. 9 is a detail view of the front part of the garment shown with the fly open and the zipper placed onto the loop fastener section in a second position (that discussed in connection with FIG. 7 above). The position shown in this figure is the position that results in the tightest waistband (smallest width). Although only two positions are shown, the second part 13*b* of the zipper 13 may be positioned on the loop fastener section 6 in either of the positions shown in FIGS. 8 and 9 or anywhere in between them. Whenever the second part 13*b* of the zipper 13 is repositioned, the bottom edge 5*b* of the hook fastener strip and the bottom edge 13*c* of the zipper (both of which are sewn to the overlying 3 and underlying fabric 4 at the joinder seam 15) remain stationary.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. An adjustable contour waist system comprising:

(a) a garment having a waistband and a fly area;

(b) a first belt loop situated on the waistband on a first side of the fly area;

(c) a second belt loop situated on the waistband on a second side of the fly area; and (d) a piece of webbing that is sewn to the waistband and configured to pass through the second belt loop;

wherein the fly area comprises an overlying piece of fabric and an underlying piece of fabric;

wherein the fly area further comprises a hook-and-loop fastener consisting of a strip of hook fastener material and a section of loop fastener material;

wherein the waistband comprises a first end that is sewn to the overlying piece of fabric and a second end that is sewn to the underlying piece of fabric so that the first end and the second end overlap one another;

wherein the first end of the waistband comprises a first edge, and a first buckle part extends laterally from the first edge of the first end;

wherein the piece of webbing comprises a second buckle part that is configured to form a clasp together with the first buckle part;

wherein the second buckle part is configured to slide on the piece of webbing to tighten or loosen the waistband;

wherein the fly area comprises a zipper that is sewn onto the underlying fabric and is parallel to an inside edge of the underlying fabric;

wherein the zipper comprises a first part and a second part;

wherein the strip of hook fastener material is sewn onto the second part of the zipper so that the strip of hook fastener material is parallel to the zipper;

wherein the zipper has a length, the strip of hook fastener material has a length, and the length of the zipper and the length of the strip of hook fastener material are the same;

wherein the section of loop fastener material is sewn to an underside of the overlying fabric;

wherein the section of loop fastener material comprises an inner edge and an outer edge;

wherein the section of loop fastener material has a bottom edge and a top edge that are parallel to one another;

wherein the section of loop fastener material has a width, and the width of the section of loop fastener material increases from bottom to top;

wherein the strip of hook fastener material has a constant width;

wherein the inner edge of the strip of hook fastener material is sewn to the second part of the zipper;

wherein the strip of hook fastener material comprises a bottom edge, and the only part of the strip of hook fastener material that is attached to the underlying fabric is the bottom edge of the strip of hook fastener material;

wherein the bottom edge of the strip of hook fastener material is attached to the underlying fabric by a joinder seam;

wherein the joinder seam joins the underlying fabric to the overlying fabric;

wherein the strip of hook fastener material is not affixed to the underlying fabric at any point that does not also connect the hook fastener strip to the overlying fabric;

wherein the bottom edge of the loop fastener section is situated above the joinder seam;

wherein the first part of the zipper and the second part of the zipper are secured to the overlying fabric and the underlying fabric at the joinder seam; and wherein the second part of the zipper is attached to the garment only at the joinder seam.

2. The adjustable contour waist system of claim 1, wherein the width of the section of loop fastener material at the top edge of the section of loop fastener material is twice the width of the section of loop fastener material at the bottom edge of the section of loop fastener material.

3. The adjustable contour waist system of claim 1, wherein the width of the section of loop fastener material at the top edge of the section of loop fastener material is three times the width of the strip of hook fastener material.

4. The adjustable contour waist system of claim 1, wherein the top edge of the section of loop fastener material is sewn into a bottom edge of the waistband.

5. The adjustable contour waist system of claim 1, wherein the inner edge of the section of loop fastener material is parallel to an inner edge of the overlying fabric.

6. The adjustable contour waist system of claim 1, wherein the strip of hook fastener material has a length, the section of loop fastener material has a length, and the length of the hook fastener material is greater than the length of the section of loop fastener material.

7. The adjustable contour waist system of claim 1, wherein the inner edge of the section of loop fastener material is configured so that when the fly area is closed in a first position, the inner edge of the section of loop fastener material lies directly on top of an inner edge of the strip of hook fastener material.

* * * * *